US008428500B2

(12) United States Patent
Komuro

(10) Patent No.: US 8,428,500 B2
(45) Date of Patent: Apr. 23, 2013

(54) BELT PRESSURIZING DEVICE AND IMAGE FORMING APPARATUS

(75) Inventor: Hitoshi Komuro, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 327 days.

(21) Appl. No.: 12/871,407

(22) Filed: Aug. 30, 2010

(65) Prior Publication Data

US 2011/0206426 A1 Aug. 25, 2011

(30) Foreign Application Priority Data

Feb. 19, 2010 (JP) ..... 2010-035343

(51) Int. Cl.
*G03G 15/01* (2006.01)

(52) U.S. Cl.
USPC ..... 399/329; 399/313; 399/278

(58) Field of Classification Search ..... 399/329, 399/313, 162.278, 288
See application file for complete search history.

(56) References Cited

U.S. PATENT DOCUMENTS

2008/0199232 A1* 8/2008 Takemura ..... 399/329

FOREIGN PATENT DOCUMENTS

| | | |
|---|---|---|
| JP | A-2002-23534 | 1/2002 |
| JP | A-2004-361580 | 12/2004 |
| JP | A-2009-116141 | 5/2009 |

* cited by examiner

*Primary Examiner* — Walter L Lindsay, Jr.
*Assistant Examiner* — Roy Y Yi
(74) *Attorney, Agent, or Firm* — Oliff & Berridge, PLC

(57) ABSTRACT

A belt pressurizing device includes: an endless belt that is circularly driven; a pressing member that presses the endless belt against a facing member with the endless belt interposed between the pressing member and the facing member; and a lubricant supplying member that supplies lubricant to reduce sliding resistance of the endless belt pressed by the pressing member, so as not to be in contact with the endless belt.

20 Claims, 8 Drawing Sheets

BELT PRESSURIZING DEVICE AND IMAGE FORMING APPARATUS

CROSS REFERENCE TO RELATED APPLICATIONS

This application is based on and claims priority under 35 USC §119 from Japanese Patent Application No. 2010-35343 filed Feb. 19, 2010.

BACKGROUND

1. Technical Field

The present invention relates to a belt pressurizing device and an image forming apparatus.

2. Related Art

An image forming apparatus employing an electrophotographic method uses a transfer device and a fixing device that each use an endless belt in order to downsize and speed up.

In such a transfer device and a fixing device, the endless belt is spanned (tensioned) by plural rolls in a state where tension is applied, and is circularly driven. The endless belt is used in such a manner that the endless belt is brought into contact with a pressing member (also referred to as a pressurizing member), such as a transfer roll, a pad or a pressure roll, and is thereby pressurized (pressed). For this reason, the endless belt is supplied with lubricant in order to perform smooth sliding of the endless belt pressed by the pressing member.

SUMMARY

According to an aspect of the present invention, there is provided a belt pressurizing device including: an endless belt that is circularly driven; a pressing member that presses the endless belt against a facing member with the endless belt interposed between the pressing member and the facing member; and a lubricant supplying member that supplies lubricant to reduce sliding resistance of the endless belt pressed by the pressing member, so as not to be in contact with the endless belt.

BRIEF DESCRIPTION OF THE DRAWINGS

Exemplary embodiment(s) of the present invention will be described in detail based on the following figures, wherein.

DETAILED DESCRIPTION

Exemplary embodiments of the present invention will be described below in detail with reference to the accompanying drawings.

<First Exemplary Embodiment>

Figure 1:
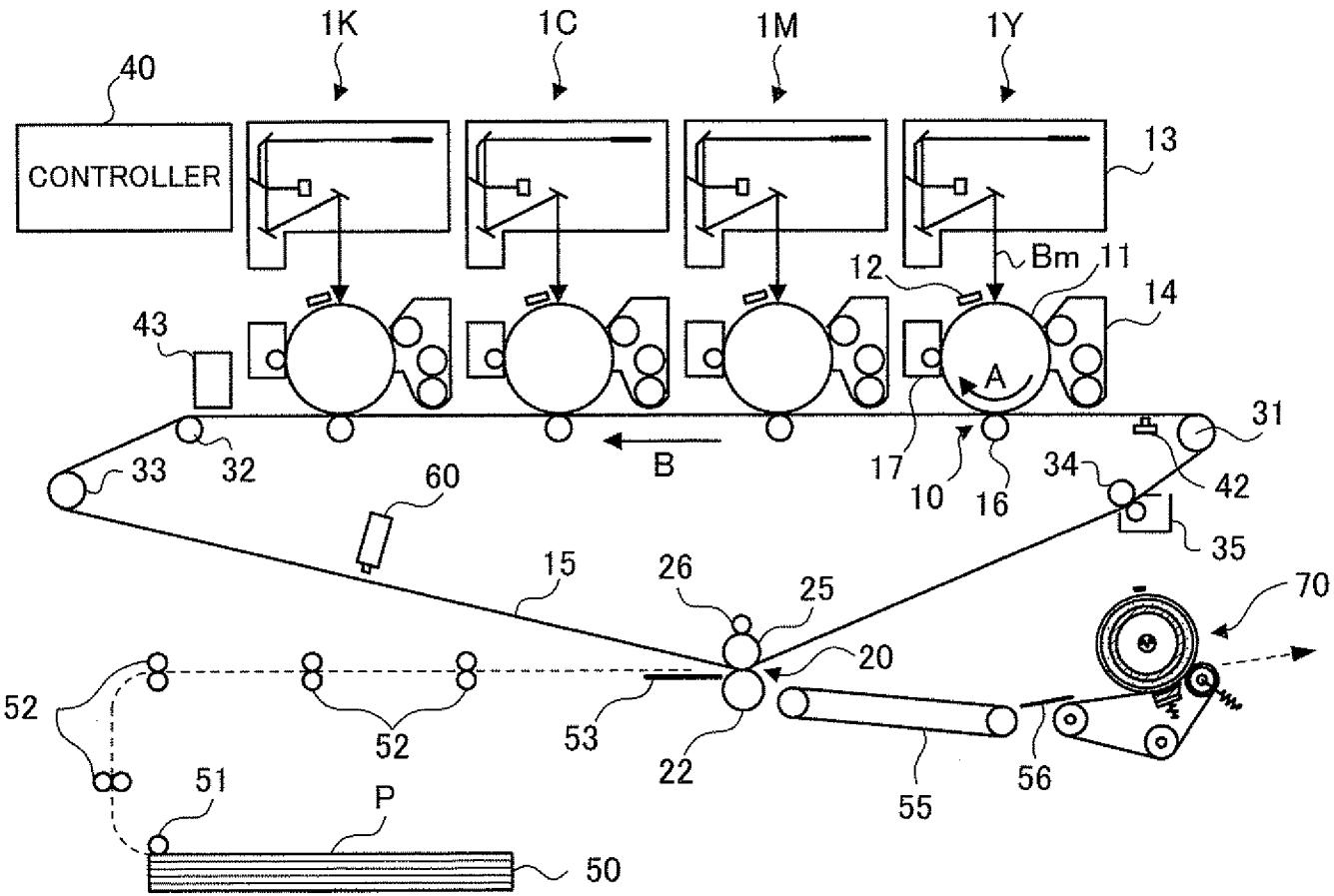
FIG. 1 is a schematic configuration diagram showing an example of an image forming apparatus using a belt pressurizing device of the first exemplary embodiment.

FIG. 1 is a schematic configuration diagram showing an example of an image forming apparatus using a belt pressurizing device of the first exemplary embodiment. The image forming apparatus shown in FIG. 1 is an image forming apparatus employing an intermediate transfer method generally called a tandem type. The image forming apparatus includes: plural image forming units 1Y, 1M, 1C and 1K in which toner images of respective color components are formed with an electrophotographic method; primary transfer portions 10 as an example of a transfer unit that sequentially transfer (primarily transfer) the toner images of the respective color components formed in the image forming units 1Y, 1M, 1C and 1K, onto an intermediate transfer belt 15 serving as an example of an endless belt; a secondary transfer portion 20 as an example of the transfer unit that collectively transfers (secondarily transfers) superimposed toner images having been transferred onto the intermediate transfer belt 15, onto a sheet P serving as an example of a transferred body; a micro droplet ejection device 60 (an ejection device) as an example of a lubricant supplying member that supplies lubricant to reduce sliding resistance of the intermediate transfer belt 15; and a fixing device 70 as an example of a fixing unit that fixes the secondarily transferred images on the sheet P. In addition, the image forming apparatus includes a controller 40 that controls operations of the respective devices (respective portions).

In the first exemplary embodiment, each of the image forming units 1Y, 1M, 1C and 1K includes electrophotographic devices, such as a charging device 12, a laser exposure device 13, a developing device 14, a primary transfer roll 16, a drum cleaner 17, which are sequentially disposed around a photoconductive drum 11 serving as an example of an image carrier that rotates in the direction of an arrow A. The charging device 12 serving as an example of a charging unit charges the photoconductive drum 11. The laser exposure device 13 serving as an example of an exposure unit writes an electrostatic latent image on the photoconductive drum 11 (an exposure beam thereof is denoted by Bm in FIG. 1). The developing device 14 serving as an example of a developing unit stores a toner of a corresponding color component and visualizes the electrostatic latent image on the photoconductive drum 11 with the toner. The primary transfer roll 16 serving as an example of a pressing member transfers a toner image of the corresponding color component formed on the photoconductive drum 11, onto the intermediate transfer belt 15 at the primary transfer portion 10. The drum cleaner 17 removes a residual toner on the photoconductive drum 11. The image forming units 1Y, 1M, 1C and 1K are linearly arranged from an upstream side of the intermediate transfer belt 15, in order of yellow (Y), magenta (M), cyan (C) and black (K).

The intermediate transfer belt 15, which is an intermediate transfer body, is configured by a film-shaped endless belt made of resin, such as polyimide or polyamide, containing an appropriate amount of an antistatic agent, such as carbon black. The intermediate transfer belt 15 is formed so that the volume resistivity thereof is $10^6$ to $10^{14}$ Ωcm and the thickness thereof is about 0.1 mm, for example. The intermediate transfer belt 15 is circularly driven (rotated) at a predetermined speed in the direction of an arrow B shown in FIG. 1, by various rolls. As these various rolls, a drive roll 31, a supporting roll 32, a tension roll 33, a back-up roll 25 and a cleaning back-up roll 34 are disposed. The drive roll 31 is driven by a motor (not shown) excellent in a constant-speed property to rotate the intermediate transfer belt 15. The supporting roll 32 supports the intermediate transfer belt 15 linearly extending along an arrangement direction of the photoconductive drums 11. The tension roll 33 functions as a correction roll to prevent the intermediate transfer belt 15 from meandering, while applying constant tension to the intermediate transfer belt 15. The back-up roll 25 is provided at the secondary transfer portion 20. The cleaning back-up roll 34 is provided at a cleaning unit that scrapes off the residual toner on the intermediate transfer belt 15.

Each of the primary transfer portions 10 is configured by the primary transfer roll 16 that is arranged so as to face the photoconductive drum 11 with the intermediate transfer belt 15 interposed therebetween. The primary transfer roll 16 is configured by a shaft and a sponge layer as an elastic body layer fixedly attached around the shaft. The shaft is a cylindrical stick made of a metal such as iron or SUS. The sponge layer is a cylindrical spongy roll made of a rubber blend of NBR, SBR and EPDM containing a conductive agent such as carbon black, and has volume resistivity of $10^7$ to $10^9$ Ωcm. The primary transfer roll 16 is arranged so as to be in pressure contact with the photoconductive drum 11 with the intermediate transfer belt 15 interposed therebetween. That is, the primary transfer roll 16 presses the photoconductive drum 11 serving as a roll, with the intermediate transfer belt 15 interposed therebetween. Thus, the intermediate transfer belt 15 is pressed by the primary transfer roll 16 at the primary transfer portion 10, which tends to prevent the intermediate transfer belt 15 from smoothly rotating.

Moreover, a voltage (a primary transfer bias) having a polarity opposite to the charging polarity of the toner (assumed to be a minus polarity) is applied to the primary transfer roll 16. Thereby, the toner images on the respective photoconductive drums 11 are electrostatically attracted to the intermediate transfer belt 15 in sequence, and then, superimposed toner images are formed on the intermediate transfer belt 15.

The secondary transfer portion 20 is configured by a secondary transfer roll 22 serving as an example of the pressing member that is arranged on a toner-image holding surface side of the intermediate transfer belt 15, and the back-up roll 25. The back-up roll 25 is configured by a surface that is a tube made of a rubber blend of EPDM and NBR in which carbon black is dispersed, and an inside made of EPDM rubber. The back-up roll 25 is formed so that the surface resistivity thereof is $10^7$ to $10^{10}$ Ω/sq., and the hardness thereof is set to 70 degrees (Asker C), for example. The back-up roll 25 is arranged on a back surface side of the intermediate transfer belt 15, functions as an opposite electrode of the secondary transfer roll 22, and is in contact with a metallic power feeding roll 26 to which a secondary transfer bias is stably applied.

The secondary transfer roll 22 is configured by a shaft, and a sponge layer as an elastic body layer fixedly attached around the shaft. The shaft is a cylindrical stick made of a metal such as iron or SUS. The sponge layer is a cylindrical spongy roll made of a rubber blend of NBR, SBR and EPDM containing a conductive material such as carbon black, and has volume resistivity of $10^7$ to $10^9$ Ωcm. The secondary transfer roll 22 is arranged so as to be in pressure contact with the back-up roll 25 with the intermediate transfer belt 15 interposed therebetween. That is, the secondary transfer roll 22 presses the back-up roll 25 with the intermediate transfer belt 15 interposed therebetween. Thus, the intermediate transfer belt 15 is pressed by the secondary transfer roll 22 at the secondary transfer portion 20, which tends to prevent the intermediate transfer belt 15 from smoothly rotating.

Moreover, the secondary transfer roll 22 is grounded to form the secondary transfer bias between the secondary transfer roll 22 and the back-up roll 25. Thereby, the toner image is secondarily transferred onto the sheet P transported to the secondary transfer portion 20.

On the downstream side of the secondary transfer portion 20 in relation to the intermediate transfer belt 15, an intermediate transfer belt cleaner 35 is provided so as to be freely moved toward and away from the intermediate transfer belt 15. The intermediate transfer belt cleaner 35 removes the residual toner and paper dust on the intermediate transfer belt 15 after the secondary transfer, thereby to clean the surface of the intermediate transfer belt 15. On the other hand, on the upstream side of the image forming unit 1Y for yellow, a reference sensor (a home position sensor) 42 is disposed. The reference sensor 42 generates a reference signal as a reference for adjusting timing for image formation in the image forming units 1Y, 1M, 1C and 1K. Additionally, on the downstream side of the image forming unit 1K for black, an image density sensor 43 for adjusting image quality is disposed. The reference sensor 42 generates the reference signal in response to recognition of a predetermined mark provided on the back side of the intermediate transfer belt 15. The image forming units 1Y, 1M, 1C and 1K are configured so as to start image formation in response to an instruction from the controller 40 based on the recognition of the reference signal.

Furthermore, as a sheet transportation system, the image forming apparatus of the first exemplary embodiment includes: a sheet supplying unit 50 that stores the sheet P; a pick-up roll 51 that takes out the sheet P stacked on the sheet supplying unit 50 at predetermined timing and transports the sheet P; transport rolls 52 that transport the sheet P taken out by the pick-up roll 51; a sheet transport path 53 through which the sheet P transported by the transport rolls 52 is further transported to the secondary transfer portion 20; a transport belt 55 that transports, to the fixing device 70, the sheet P to be transported after the secondary transfer by the secondary transfer roll 22; and a fixing entrance guide 56 that guides the sheet P to the fixing device 70.

Furthermore, on the upstream side of the secondary transfer portion 20 in relation to the intermediate transfer belt 15, the micro droplet ejection device 60 that supplies lubricant to reduce sliding resistance of the intermediate transfer belt 15 is provided so as not to be in contact with the intermediate transfer belt 15. Note that plural micro droplet ejection devices 60 are installed with predetermined intervals in the width direction of the intermediate transfer belt 15, namely, in the depth direction of FIG. 1 (see FIGS. 3A and 3B to be described later).

The micro droplet ejection device 60 may employ an ink jet method as will be described later. The micro droplet ejection device 60 supplies lubricant of a predetermined amount as micro droplets, at predetermined timing, to an inner surface of the loop of the intermediate transfer belt 15, namely, a surface at which the intermediate transfer belt 15 is in contact with the primary transfer rolls 16, the back-up roll 25, the drive roll 31, the supporting roll 32 and the tension roll 33. Note that the inner surface of the loop of the intermediate transfer belt 15 is hereinafter called the back surface of the intermediate transfer belt 15.

The supplied lubricant spreads on the back surface of the intermediate transfer belt 15, and thereby reduces the sliding resistance of the intermediate transfer belt 15 at the primary transfer portions 10 and the secondary transfer portion 20. This makes rotation of the intermediate transfer belt 15 smooth.

Note that the micro droplet ejection device 60 may supply micro droplets of lubricant in an operation state where the intermediate transfer belt 15 is provided with tension and rotated. Instead, the micro droplet ejection device 60 may make the intermediate transfer belt 15 be in a stopped state to supply micro droplets of lubricant.

As described above, in the first exemplary embodiment, the intermediate transfer belt 15, which is an endless belt, is provided with tension by plural rolls, such as the drive roll 31, the supporting roll 32, the tension roll 33 and the back-up roll 25, and is circularly driven (rotated). Additionally, at each of the primary transfer portions 10, the primary transfer roll 16 presses the photoconductive drum 11 with the intermediate transfer belt 15 interposed therebetween. Furthermore, at the secondary transfer portion 20, the secondary transfer roll 22 presses the back-up roll 25 with the intermediate transfer belt 15 interposed therebetween. A device including an endless belt provided with tension by plural rolls and a pressing member pressing the endless belt, as described above, is called a belt pressurizing device. In the first exemplary embodiment, the belt pressurizing device is configured as a transfer device including the micro droplet ejection device 60.

Next, a description is given of a basic image forming process of the image forming apparatus according to the first exemplary embodiment. In the image forming apparatus shown in FIG. 1, image data outputted from an unillustrated image reading apparatus, an unillustrated personal computer (PC) or the like is subjected to predetermined image processing by an unillustrated image processor, and is then subjected to an image forming operation by the image forming units 1Y, 1M, 1C and 1K. In the image processor, inputted reflectance data is subjected to predetermined image processing, such as shading correction, displacement correction, lightness and color space conversion, gamma correction, various kinds of image editing like a frame erase, color editing, move editing and the like. The image data having been subjected to the image processing is converted into color material tone data of four colors of Y, M, C and K, and is then outputted to the laser exposure device 13.

Each laser exposure device 13 irradiates the photoconductive drum 11 of the corresponding image forming unit 1Y, 1M, 1C or 1K with the exposure beam Bm outputted from a semiconductor laser, for example, in accordance with the inputted color material tone data. In each photoconductive drum 11 of the corresponding image forming unit 1Y, 1M, 1C or 1K, the surface thereof is charged by the charging device 12, and then scanned and exposed by the laser exposure device 13, and thereby an electrostatic latent image is formed thereon. The formed electrostatic latent image is developed as a toner image of each of colors of Y, M, C and K, by the developing device 14 in the corresponding image forming unit 1Y, 1M, 1C or 1K.

The toner images formed on the respective photoconductive drums 11 of the image forming units 1Y, 1M, 1C and 1K are transferred onto the intermediate transfer belt 15 at the respective primary transfer portions 10 where the photoconductive drums 11 come into contact with the intermediate transfer belt 15. More specifically, at each of the primary transfer portions 10, a voltage (the primary transfer bias) having a polarity (plus polarity) opposite to the charging polarity of the toner is applied to a base material of the intermediate transfer belt 15 by the primary transfer roll 16, and the primary transfer is carried out by superimposing the toner images on the surface of the intermediate transfer belt 15 in sequence.

After the toner images are primarily transferred to the surface of the intermediate transfer belt 15 in sequence, the toner images are transported to the secondary transfer portion 20 by movement of the intermediate transfer belt 15. When the toner images are transported to the secondary transfer portion 20, in the sheet transporting system, the pick-up roll 51 rotates in accordance with the timing when the toner images are transported to the secondary transfer portion 20, and the sheet P having a predetermined size is supplied from the sheet supplying unit 50. The sheet P supplied by the pick-up roll 51 is transported by the transport rolls 52, and reaches the secondary transfer portion 20 through the sheet transport path 53. Before reaching the secondary transfer portion 20, the sheet P is stopped once. Then, a registration roll (not shown) rotates in accordance with the moving timing of the intermediate transfer belt 15 on which the toner images are held, so that the position of the sheet P and the position of the toner images are aligned.

At the secondary transfer portion 20, the secondary transfer roll 22 is pressed against the back-up roll 25 through the intermediate transfer belt 15. The sheet P transported at right timing is sandwiched between the intermediate transfer belt 15 and the secondary transfer roll 22. At this time, when a voltage (the secondary transfer bias) having the same polarity (minus polarity) as the charging polarity of the toner is applied by the power feeding roll 26, a transfer electric field is formed between the secondary transfer roll 22 and the back-up roll 25. Then, the unfixed toner images held on the intermediate transfer belt 15 are collectively and electrostatically transferred onto the sheet P at the secondary transfer portion 20 where the intermediate transfer belt 15 is pressed by the secondary transfer roll 22 and the back-up roll 25.

Thereafter, the sheet P on which the toner images are electrostatically transferred is transported in a state where the sheet P is peeled from the intermediate transfer belt 15 by the secondary transfer roll 22, and further transported to the transport belt 55 provided on the downstream side of the secondary transfer roll 22 in the sheet transporting direction. On the transport belt 55, the sheet P is transported to the fixing device 70 at an optimal transporting speed in accordance with a transporting speed in the fixing device 70. The unfixed toner images on the sheet P transported to the fixing device 70 are fixed on the sheet P by fixing processing with heat and pressure in the fixing device 70. The sheet P on which the fixed image is formed is then transported to a discharged sheet container (not shown) provided at an exit portion of the image forming apparatus.

On the other hand, after the transfer onto the sheet P is finished, the residual toner on the intermediate transfer belt 15 is transported along with the rotation of the intermediate transfer belt 15, and is removed from the intermediate transfer belt 15 by the cleaning back-up roll 34 and the intermediate transfer belt cleaner 35.

Figure 2B:
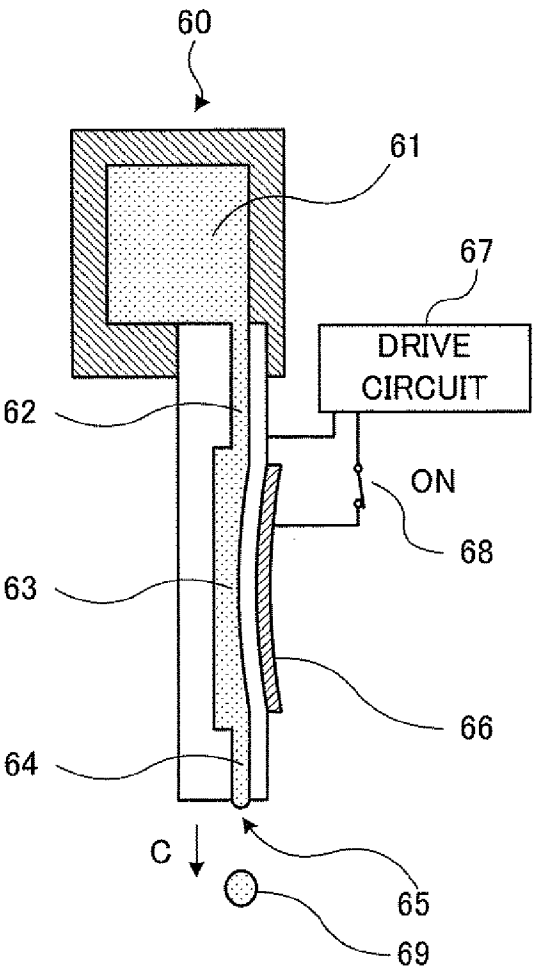
FIGS. 2A and 2B are diagrams showing an example of a cross-sectional structure and an operation of the micro droplet ejection device.
Figure 2A:
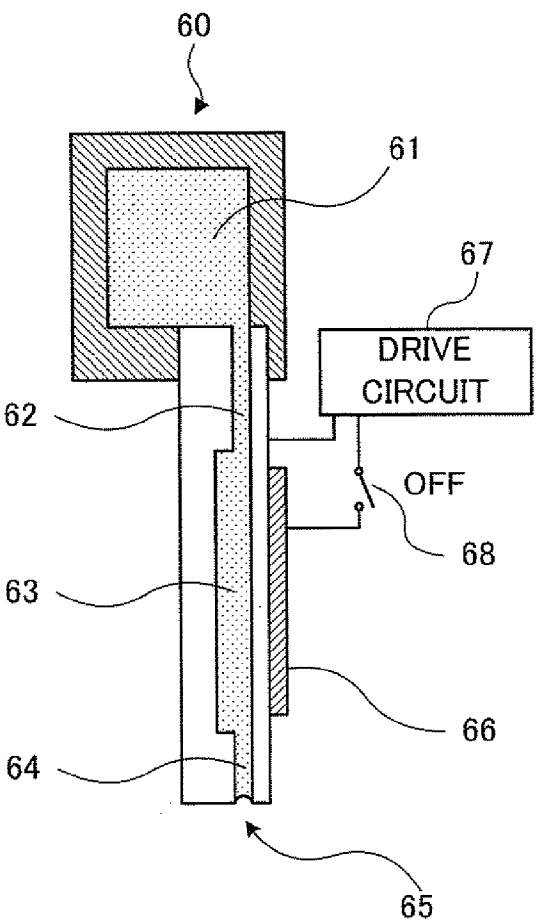

FIGS. 2A and 2B are diagrams showing an example of a cross-sectional structure and an operation of the micro droplet ejection device 60. The micro droplet ejection device 60 shown in FIGS. 2A and 2B is a micro droplet ejection device 60 employing a piezoelectric method using a piezoelectric (piezo) element 66. FIG. 2A shows the cross-sectional structure of the micro droplet ejection device 60 in a state (an OFF state) where a voltage is not applied to the piezoelectric element 66, while FIG. 2B shows the cross-sectional structure of the micro droplet ejection device 60 in a state (an ON state) where a voltage is applied to the piezoelectric element 66.

The micro droplet ejection device 60 includes: a liquid storage portion 61; a first conduit 62; a liquid chamber portion 63 connected to the liquid storage portion 61 through the first conduit 62; a second conduit 64 connected to the liquid chamber portion 63; and an ejecting portion (a nozzle) 65 provided at an end of the second conduit 64 and opened toward outside.

The liquid storage portion 61 stores liquid lubricant to be described later. Since the first conduit 62, the liquid chamber portion 63 and the second conduit 64 are connected to the liquid storage portion 61, the lubricant flows through the first conduit 62, the liquid chamber portion 63 and the second conduit 64, sequentially, and fills the first conduit 62, the liquid chamber portion 63 and the second conduit 64. The cross-sectional areas (surfaces orthogonal to the direction in which the lubricant flows) of the first conduit 62 and the second conduit 64 are set to be smaller than the cross-sectional area (a surface orthogonal to the direction in which the lubricant flows) of the liquid chamber portion 63.

The micro droplet ejection device 60 includes the piezoelectric element 66 provided with a wall interposed between the piezoelectric element 66 and the liquid chamber portion 63. Furthermore, the micro droplet ejection device 60 includes: a drive circuit 67 for applying a voltage to the piezoelectric element 66; and a switch 68 provided for interrupting the electrical connection between the drive circuit 67 and the piezoelectric element 66.

Here, a description is given of the operation of the micro droplet ejection device 60 according to the first exemplary embodiment, with reference to FIGS. 2A and 2B.

First, referring to FIG. 2A, a description is given of the state (the OFF state) where the switch 68 is off (OFF) and a voltage is not applied to the piezoelectric element 66.

The liquid storage portion 61 of the micro droplet ejection device 60 stores liquid lubricant. The lubricant herein only needs to have heat resistance and predetermined viscosity. For example, fluorinated oil, modified fluorinated oil, methylphenyl silicone oil, dimethyl silicone oil, amine-modified silicone oil or the like may be used. In particular, amine-modified silicone oil is preferable to be used in terms of small viscosity change with respect to temperature change.

As described above, the liquid storage portion 61 of the micro droplet ejection device 60 is connected to the liquid chamber portion 63 through the first conduit 62, and further connected to the ejecting portion 65 through the second conduit 64. Thus, the lubricant fills the first conduit 62, the liquid chamber portion 63 and the second conduit 64. However, the lubricant is held by surface tension at the ejecting portion 65, and thus does not leak out. Specifically, the viscosity of the lubricant and the shape of the ejecting portion 65 are set so that the lubricant does not leak out from the ejecting portion 65 in the state where the switch 68 is off (OFF).

Next, referring to FIG. 2B, a description is given of the state (the ON state) where the switch 68 is on (ON) and a voltage is applied to the piezoelectric element 66.

When the switch 68 is turned on (ON), the piezoelectric element 66 of the micro droplet ejection device 60 deforms due to the piezoelectric effect so as to deflate the liquid chamber portion 63. Then, the lubricant stored in the liquid chamber portion 63 tries to move to the liquid storage portion 61 or the ejecting portion 65, because the liquid chamber portion 63 and the liquid storage portion 61 are connected through the first conduit 62 and the liquid chamber portion 63 and the ejecting portion 65 are connected through the second conduit 64. However, the lubricant hardly moves because the cross-sectional areas of the first conduit 62 and the second conduit 64 are set to be smaller than the cross-sectional area of the liquid chamber portion 63. Thus, the deformation of the piezoelectric element 66 raises the fluid pressure in the liquid chamber portion 63. Then, the lubricant is ejected as a droplet 69 in the direction of an arrow C from the ejecting portion 65 opened toward outside, in accordance with the rise of the fluid pressure in the liquid chamber portion 63.

Accordingly, if the intermediate transfer belt 15, which is a target for supply of the lubricant, is located close to the ejecting portion 65 of the micro droplet ejection device 60, the lubricant is supplied to the back surface of the intermediate transfer belt 15.

Next, when the switch 68 is turned off (OFF) to change the piezoelectric element 66 to the state (the OFF state) where a voltage is not applied thereto, the piezoelectric element 66 recovers the original shape. Then, the lubricant whose amount is equal to the amount ejected from the liquid chamber portion 63 as the droplets 69 is supplied from the liquid storage portion 61 to the liquid chamber portion 63 through the first conduit 62. This leads to the state shown in FIG. 2A. Thereafter, the above-mentioned operation is repeated.

The ejected amount of the lubricant is controlled depending on the number of the droplets 69 ejected per unit time and the size of the droplet 69 determined by the deformation amount of the piezoelectric element 66.

Accordingly, the amount of the lubricant to be supplied may be set, taking into consideration the lubrication effect of the lubricant on the intermediate transfer belt 15, such as spread of the droplets 69 of the lubricant on the surface of the intermediate transfer belt 15.

As described above, the deformation of the piezoelectric element 66 due to the piezoelectric effect decreases the volume of the liquid chamber portion 63 to raise the fluid pressure, and thereby the micro droplet ejection device 60 ejects the lubricant from the ejecting portion 65. For this reason, the wall separating the liquid chamber portion 63 from the piezoelectric element 66 is configured so as to be deformable by the piezoelectric element 66.

Listed as examples of the piezoelectric element 66 used in the micro droplet ejection device 60 are: crystal, zinc oxide (ZnO), Rochelle salt (potassium sodium tartrate) ($KNaC_4H_4O_6$), lead zirconate titanate (PZT: $Pb(Zr,Ti)O_3$), lithium niobate ($LiNbO_3$), lithium tantalite ($LiTaO_3$), lithium tetraborate ($Li_2B_4O_7$), langasite ($La_3Ga_5SiO_{14}$), aluminum nitride, tourmaline, polyvinylidene fluoride (PVDF).

In FIGS. 2A and 2B, the ejecting portion 65 of the micro droplet ejection device 60 is configured so as to face downward in the figures. However, since the lubricant is ejected by the rise of the fluid pressure due to the volume change of the liquid chamber portion 63, the ejected amount of the lubricant from the micro droplet ejection device 60 is hardly affected by the gravity. For this reason, the ejecting portion 65 of the micro droplet ejection device 60 may face upward or sideward. For example, the micro droplet ejection device 60 shown in FIGS. 2A and 2B may be turned upside down to use, or laid down to use. Instead, the second conduit 64 may be bent in L-shape so that the lubricant is ejected in the lateral direction.

Additionally, the drive circuit 67 and the switch 68 may be configured close to the liquid storage portion 61 and the liquid chamber portion 63 so as to be contained inside of the micro droplet ejection device 60. Instead, the drive circuit 67 and the switch 68 may be led out with a wire, and provided on a circuit board or the like located apart from the liquid storage portion 61 and the liquid chamber portion 63.

In FIGS. 2A and 2B, the description has been given assuming that the micro droplet ejection device 60 employs the piezoelectric method using the piezoelectric element 66. However, the micro droplet ejection device 60 may employ not the piezoelectric method, but a configuration in which pressure of bubbles generated in the liquid chamber portion 63 causes the lubricant to be ejected outside as the droplets 69. However, the micro droplet ejection device 60 may use the piezoelectric element 66 that is hardly affected by heating, if the belt pressurizing device is configured as a fixing device and heated for fixing, which will be described later.

Figure 3A:
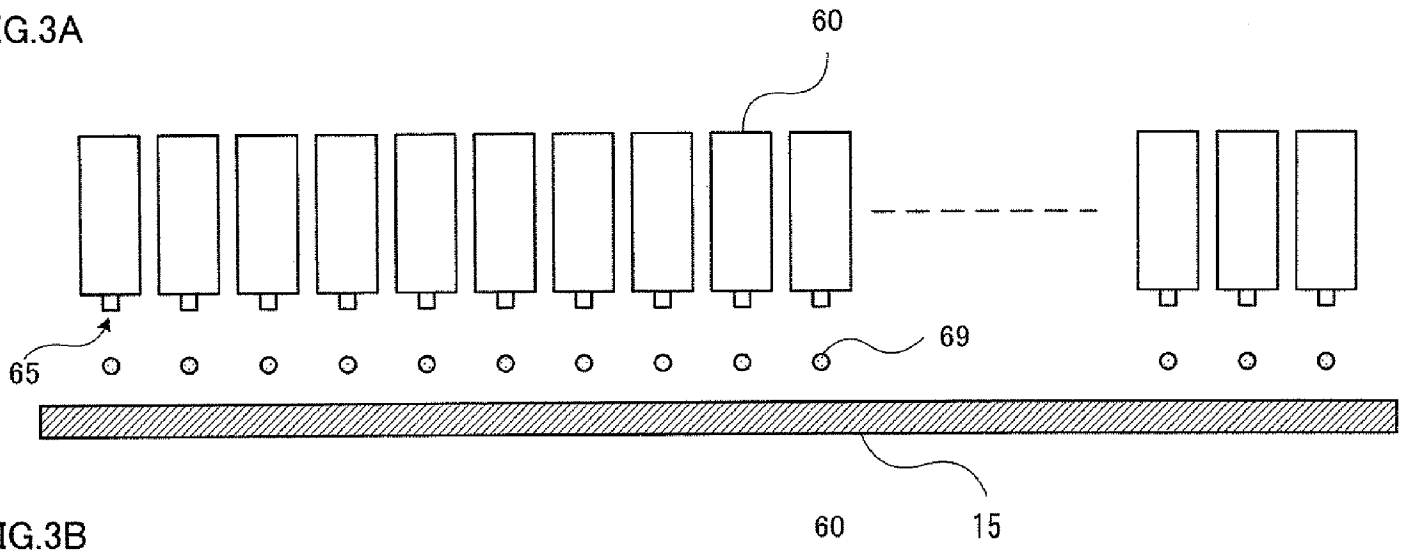
FIGS. 3A and 3B are diagrams showing an example of arrangement of the micro droplet ejection devices and the intermediate transfer belt.
Figure 3B:
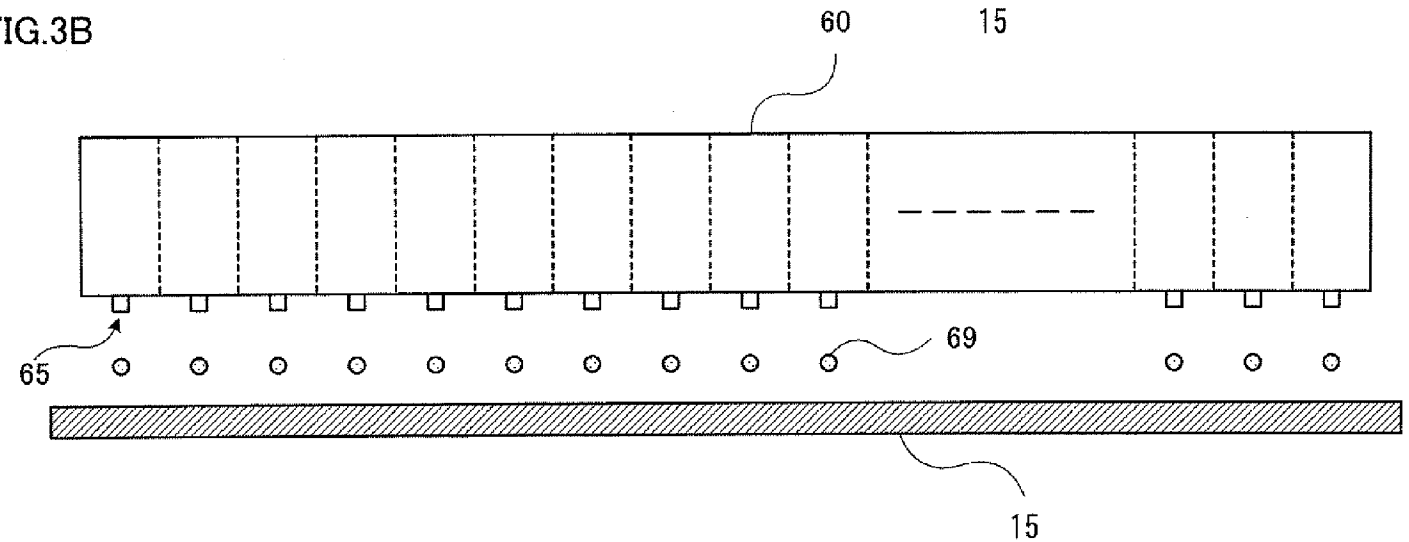

FIGS. 3A and 3B are diagrams showing an example of arrangement of the micro droplet ejection devices 60 and the intermediate transfer belt 15. FIG. 3A shows the plural micro droplet ejection devices 60 arrayed in the width direction (a direction orthogonal to the paper in FIG. 1) of the intermediate transfer belt 15. FIG. 3B shows the plural micro droplet ejection devices 60 integrally formed so as to be capable of applying the lubricant over the width direction of the intermediate transfer belt 15. Note that FIGS. 3A and 3B show the micro droplet ejection devices 60 as figures in which the micro droplet ejection device 60 shown in FIGS. 2A and 2B is seen from the right side of the paper.

In FIG. 3A, the plural micro droplet ejection devices 60 are arrayed in the width direction of the intermediate transfer belt 15 with an unillustrated fastening member so as to cover the entire width of the intermediate transfer belt 15. All the micro droplet ejection devices 60 are operated at the same timing to eject the droplets 69 of the lubricant to the back surface of the intermediate transfer belt 15.

The pitch of the ejecting portions 65 and the number of the arrayed micro droplet ejection devices 60 are set depending on the width of the intermediate transfer belt 15 and spread of the droplets 69 on the intermediate transfer belt 15. Accordingly, for the configuration shown in FIG. 3A, the pitch of the ejecting portions 65 and the number of the arrayed micro droplet ejection devices 60 may be set, taking into consideration the width of the intermediate transfer belt 15 and spread of the droplets 69 on the intermediate transfer belt 15.

In FIG. 3B, the plural micro droplet ejection devices 60 are bonded in the width direction of the intermediate transfer belt 15, and integrally formed so as to cover the entire width of the intermediate transfer belt 15. Since being integrally formed, the plural micro droplet ejection devices 60 are easily handled. However, the pitch and the number of the ejecting portions 65 (the latter of which corresponds to the width of the intermediate transfer belt 15) are set in advance.

If the plural micro droplet ejection devices 60 are integrally formed, one liquid storage portion 61 may be shared with some micro droplet ejection devices 60.

Additionally, although not shown, the plural micro droplet ejection devices 60 may be divided into plural blocks, and the micro droplet ejection devices 60 may be integrally formed for each of the blocks.

Although all the micro droplet ejection devices 60 eject the droplets 69 of the lubricant to the intermediate transfer belt 15 at the same timing in FIGS. 3A and 3B, the timing of ejecting the lubricant may be adjusted for each of the micro droplet ejection devices 60.

As described above, supply of the lubricant to the intermediate transfer belt 15 is performed by the micro droplet ejection devices 60, and thus the ejected amount of the lubricant is easily controlled. In addition, the plural micro droplet ejection devices 60 are arranged over the entire region in the width direction of the intermediate transfer belt 15, and a micro droplet ejection device 60 located at a position where the lubricant is needed ejects the lubricant as the droplets 69, which makes the lubricant supplied only at the position where the lubricant is needed. For example, more lubricant may be supplied at the center part in the width direction of the intermediate transfer belt 15 so that the lubricant does not leak from the edge portions of the intermediate transfer belt 15. The lubricant may also be supplied when the image forming apparatus is started to use, and supplied in accordance with conditions such as the number of sheets (the number of rotations of the intermediate transfer belt 15) per job. Furthermore, the supply amount of the lubricant may be increased immediately after the replacement of the intermediate transfer belt 15.

Figure 4:
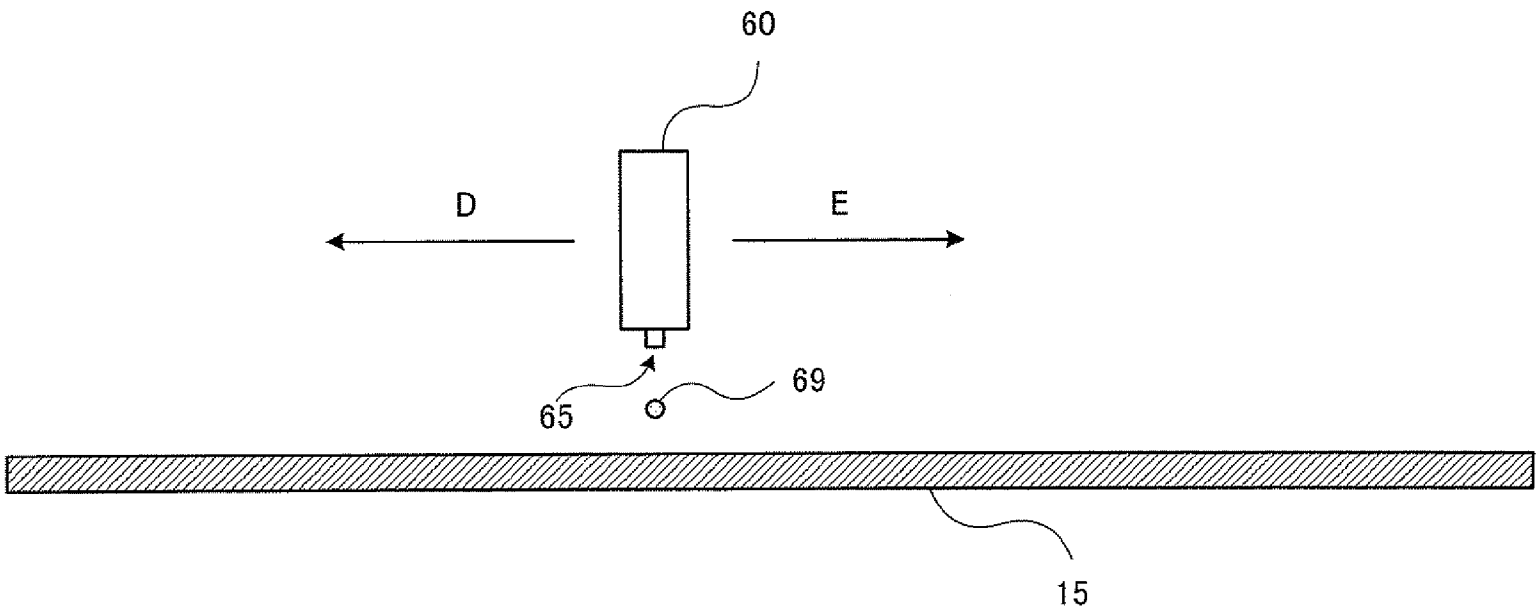
FIG. 4 is a diagram showing another example of arrangement of the micro droplet ejection device and the intermediate transfer belt.

FIG. 4 is a diagram showing another example of arrangement of the micro droplet ejection device 60 and the intermediate transfer belt 15. Here, one micro droplet ejection device 60 ejects the droplets 69 while being moved in the width direction (the direction of an arrow D or E) of the intermediate transfer belt 15 by an unillustrated drive device.

An appropriate amount of the lubricant may be supplied by this configuration.

In contrast, in a conventional case (a contact type) where the lubricant supplying member is in contact with the endless belt, much lubricant tends to be supplied at the initial stage of usage, and the supply of the lubricant decreases with the elapse of the usage time. This makes it difficult to supply a constant amount of the lubricant for a long time.

If the supply amount of the lubricant at the initial stage of usage is decreased, the lubricant supply runs short with the elapse of the usage time. This raises sliding resistance, and thus leads to occurrence of a defect in an image formed on a sheet being a recording medium and occurrence of wrinkles (paper wrinkles) on a sheet.

On the other hand, if the supply amount of the lubricant at the initial stage of usage is increased, the lubricant leaks from the edge portions of the endless belt to the transfer roll, a fixing roll, the pressing member, the sheet and the like. This leads to occurrence of shape abnormality of the transfer roll, the fixing roll, the pressing member and the like, and a stain of the sheet.

Furthermore, if the lubricant supplying member is in contact with the endless belt for a long time, the endless belt wears off, which generates abrasion powder and makes the lifetime of the endless belt shorter.

In the first exemplary embodiment, the micro droplet ejection device 60 supplies the lubricant to the intermediate transfer belt 15, unlike the above-mentioned case (the contact type) where the lubricant supplying member is in contact with the endless belt. Thus, it is not necessary that the lubricant supplying member supplies excessive lubricant and a lubricant removing member removes the excessive lubricant. Furthermore, the first exemplary embodiment may prevent the difference observed in the conventional case where the lubricant supplying member is in contact with the endless belt, namely, the difference in the amount of lubricant applied on the intermediate transfer belt 15 between the initial stage of usage of the lubricant supplying member and the final stage of usage of the lubricant supplying member, in the latter of which the lubricant supply runs short.

Note that the supply amount of the lubricant is determined depending on various usage conditions: a rotational speed of the intermediate transfer belt 15; an applying pressure of the pressing member, such as the primary transfer rolls 16 and the secondary transfer roll 22; roughness of the back surface of the intermediate transfer belt 15; a material of the surface of the pressing member, such as the primary transfer rolls 16 and the secondary transfer roll 22; a material of the lubricant; the number of sheets per job; temperature; the total number of rotations of the intermediate transfer belt 15; and the like. The supply amount of the lubricant may be set on the basis of data obtained in advance by an experiment.

<Second Exemplary Embodiment>

Figure 5:
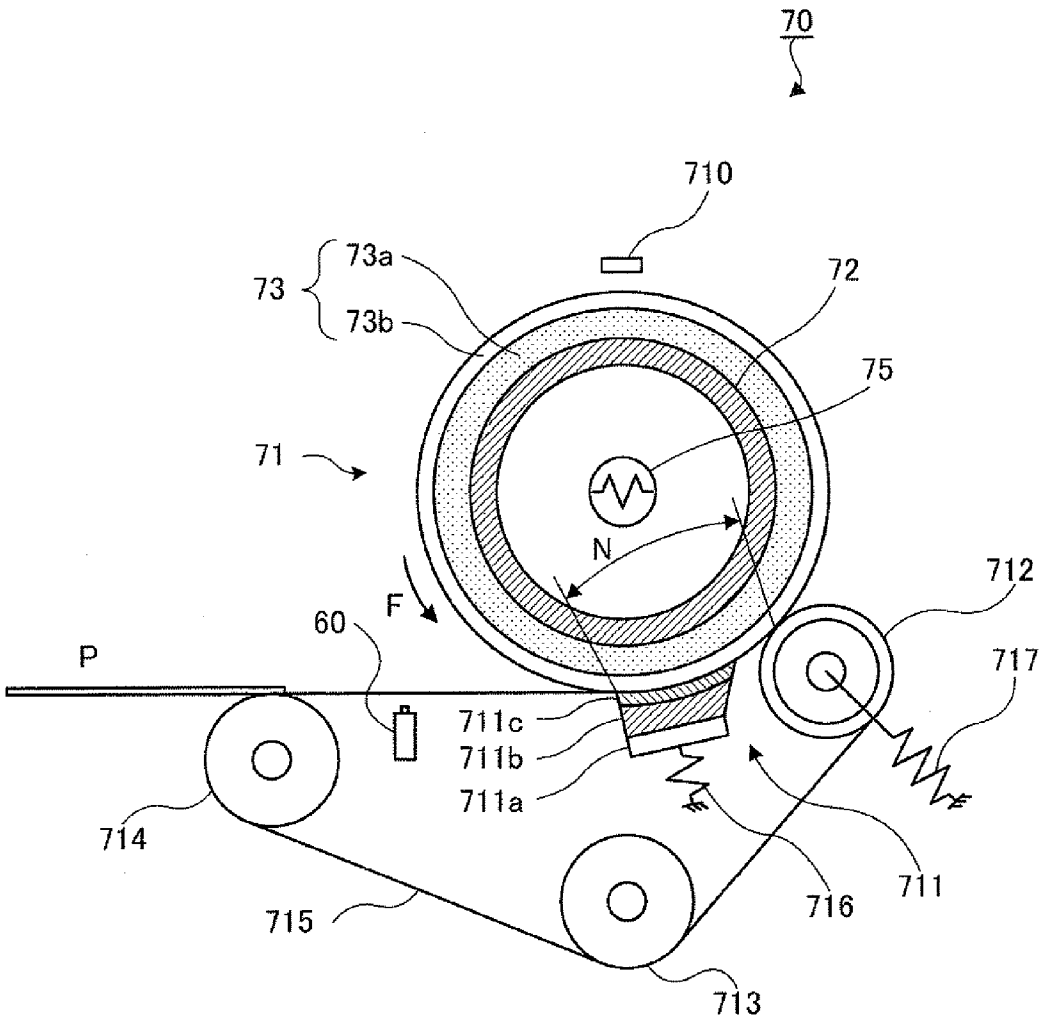
FIG. 5 is a sectional side view showing a schematic configuration of the fixing device in a case where the belt pressurizing device of the second exemplary embodiment is used in the fixing device.

FIG. 5 is a sectional side view showing a schematic configuration of the fixing device 70 in a case where the belt pressurizing device of the second exemplary embodiment is used in the fixing device 70.

The main part of the fixing device 70 to which the second exemplary embodiment is applied is configured by: a thermal fixing roll 71 that has a halogen heater 75, as a heat source, embedded therein; an endless belt 715 that is provided with tension by a pressure roll 712 and two supporting rolls 713 and 714, and is in pressure contact with the thermal fixing roll 71; and a pressure application member 711 serving as an example of the pressing member that comes into contact with the inner side of the endless belt 715, and presses the endless belt 715 along the surface of the thermal fixing roll 71.

The thermal fixing roll 71 has a cylindrical core 72 therein, and is rotationally driven in a circumferential direction (the direction of an arrow F) at a surface speed of 260 mm/sec, for example, by an unillustrated motor. The core 72 is made of aluminum having an outer diameter of 62 mm, an inner diameter of 55 mm and a length of 350 mm. The surface of the core 72 is directly covered with HTV silicone rubber having a thickness of 2 mm and durometer hardness (JIS K6253) of A/45, as a base layer 73*a*. The base layer 73*a* is further covered with a PFA (perfluoroalkylvinylether resin) tube having a thickness of 40 μm, as a top layer 73*b*. The base layer 73*a* and the top layer 73*b* forms a cover layer 73. The surface of the cover layer 73 is finished in almost mirror-like. The rubber hardness of the base layer 73*a* is a result of measurement with an A-type hardness meter of a spring type manufactured by Teclock Corporation when a load of 1000 gf is applied.

Note that any metal having high heat conductivity may be used as the core 72, instead of aluminum. As for the cover layer 73, another material may be used as long as the material has high heat resistance and elasticity.

The halogen heater 75 outputting 1000 W is arranged as a heat source inside of the core 72. Additionally, a temperature sensor 710 is arranged at a position facing the surface of the thermal fixing roll 71, and measures temperature of the surface of the thermal fixing roll 71. On the basis of signals measured by the temperature sensor 710, an unillustrated temperature controller performs feedback control on the halogen heater 75, and adjusts the temperature on the surface of the thermal fixing roll 71 to be at 175 degrees C.

The pressure application member 711 is formed by stacking an elastic layer 711*b* and a low friction layer 711*c* on the surface of a base plate 711*a*, and is pressed toward the thermal fixing roll 71 by a compression coil spring 716 arranged on the base plate 711*a* side. The base plate 711*a* has a width (in the running direction of the endless belt 715) of 20 mm, a length (in the vertical direction with respect to the paper) of 360 mm and a thickness of 5 and is a member made of stainless steel.

The elastic layer 711*b* is made of silicone sponge (silicone rubber foam) having rubber hardness of 23 degrees. The width of the elastic layer 711*b* (in the running direction of the endless belt 715) becomes gradually larger than that of the base plate 711*a* as the elastic layer 711*b* is farther from the base plate 711*a*.

Here, the rubber hardness is a result of measurement with an ASKER C-type rubber hardness meter for sponge manufactured by KOBUNSHI KEIKI CO., LTD. when a load of 300 gf is applied.

The elastic layer 711*b* has a part projecting triangularly on the pressure roll 712 side thereof. Thereby, the pressure application member 711 presses the endless belt 715 toward the thermal fixing roll 71 through a large area, and also presses the endless belt 715 located between the pressure application member 711 and the pressure roll 712, toward the thermal fixing roll 71. With this configuration, in the fixing device 70, a nip portion N that is a region where the endless belt 715 comes into pressure contact with the thermal fixing roll 71 is formed from the pressure application member 711 to the pressure roll 712.

The low friction layer 711*c* is formed of "FGF-400-4" (product name), which is a glass fiber sheet impregnated with polytetrafluoroethylene produced by Chukoh Chemical Industries, Ltd., or a thermosetting polyimide film on which embossing is performed (made uneven), the film being formed into a cylinder. The width of the contact surface (in the running direction of the endless belt 715) of the low friction layer 711*c* at the nip portion N is 15 mm.

Since the elastic layer 711*b* is provided, a contact surface at which the low friction layer 711*c* is in contact with the endless belt 715 may fit with the outer circumferential surface of the thermal fixing roll 71. Specifically, when the pressure application member 711 is pressed toward the thermal fixing roll 71 with a load above a predetermined level, the elastic layer 711*b* is deformed and thus the surface of the low friction layer 711*c* is deformed so as to be in pressure contact along with the outer circumferential surface of the thermal fixing roll 71. Therefore, when the pressure application member 711 is pressed against the thermal fixing roll 71 by the compression coil spring 716, the endless belt 715 is brought into pressure contact with the thermal fixing roll 71 without any space. Here, the width of the contact surface between the endless belt 715 and the thermal fixing roll 71 is 15 mm, and the length of the contact surface in the width direction of the endless belt 715 is 320 mm.

On the surface of the thermal fixing roll 71, the endless belt 715 having heat resistance is arranged so as to be in pressure contact therewith over the predetermined nip portion N. The endless belt 715 is formed of a polyimide film having a thickness of 75 μm, a width of 340 mm and a circumferential length of 214 mm, for example, and is provided with tension by the pressure roll 712 and the two supporting rolls 713 and 714 with tension of 5 kgf. The diameters of the pressure roll 712 and the two supporting rolls 713 and 714 are respectively set to 23 mm, 18 mm and 18 mm, for example. Additionally, the pressure roll 712 and the supporting roll 714 are made of stainless steel or the like, for example, and formed into a crown shape. The supporting roll 713 is made of stainless steel or the like whose surface is subjected to silicone rubber coating, and formed into a cylindrical or columnar member.

The pressure roll 712 is arranged so as to be in pressure contact with the surface of the thermal fixing roll 71 by a pressure of 60 kgf, for example, at the exit of the nip portion N. Note that the endless belt 715 is configured so as to rotate in accordance with rotation of the thermal fixing roll 71 with which the endless belt 715 is in pressure contact. Thus, the base layer 73*a* of the thermal fixing roll 71 is deformed, and distortion is generated on the surface of the base layer 73*a*, which allows the sheet P to peel off with its rigidity.

The fixing device 70 further includes the micro droplet ejection device 60 having a similar configuration to that shown in the first exemplary embodiment. The micro droplet ejection device 60 supplies the droplets 69 of the lubricant to the inner surface (the back surface) of the loop of the endless belt 715, namely, the surface at which the micro droplet ejection device 60 is in contact with the pressure roll 712 and the supporting rolls 713 and 714 and further with the pressure application member 711.

Note that the micro droplet ejection device 60 of the second exemplary embodiment is the same as that of the first exemplary embodiment in which the intermediate transfer belt 15 is replaced with the endless belt 715. Thus, the detailed description thereof is omitted.

As described above, in the fixing device 70 of the second exemplary embodiment, the endless belt 715 is provided with tension by the plural rolls of the pressure roll 712 and the supporting rolls 713 and 714, and is circularly driven (rotated). Additionally, the pressure application member 711 presses the thermal fixing roll 71 with the endless belt 715 interposed therebetween. Thereby, the belt pressurizing device including the micro droplet ejection device 60 is configured.

Next, a description is given of an operation of the fixing device 70. The sheet P on which a toner image is transferred at the secondary transfer portion 20 of the image forming apparatus shown in FIG. 1 is transported from the left side of FIG. 5 to the fixing device 70. The sheet P then enters the nip portion N formed by the pressure application member 711 and the thermal fixing roll 71 of the fixing device 70. The toner image is fixed on the sheet P by pressure applied to the nip portion N and heat given by the halogen heater 75 through the thermal fixing roll 71.

Also in the second exemplary embodiment, the micro droplet ejection device 60 supplies the lubricant to the endless belt 715, unlike the conventional case (the contact type) where the lubricant supplying member is in contact with the endless belt. Thus, it is not necessary that the lubricant supplying member supplies excessive lubricant and the lubricant removing member removes the excessive lubricant. Furthermore, the second exemplary embodiment may prevent the difference observed in the conventional case where the lubricant supplying member is in contact with the endless belt, namely, the difference in the amount of lubricant applied on the endless belt 715 between the initial stage of usage of the lubricant supplying member and the final stage of usage of the lubricant supplying member, in the latter of which the lubricant supply runs short.

Note that the supply amount of the lubricant is determined depending on various usage conditions: a rotational speed of the endless belt 715; an applying pressure of the pressure application member 711; roughness of the back surface of the endless belt 715; a material and roughness of the low friction layer 711*c* of the pressure application member 711; a material of the lubricant; the number of sheets per job; fixing temperature; the total number of rotations of the endless belt 715; and the like. The supply amount of the lubricant may be set on the basis of data obtained in advance by an experiment.

<Third Exemplary Embodiment>

Figure 6:
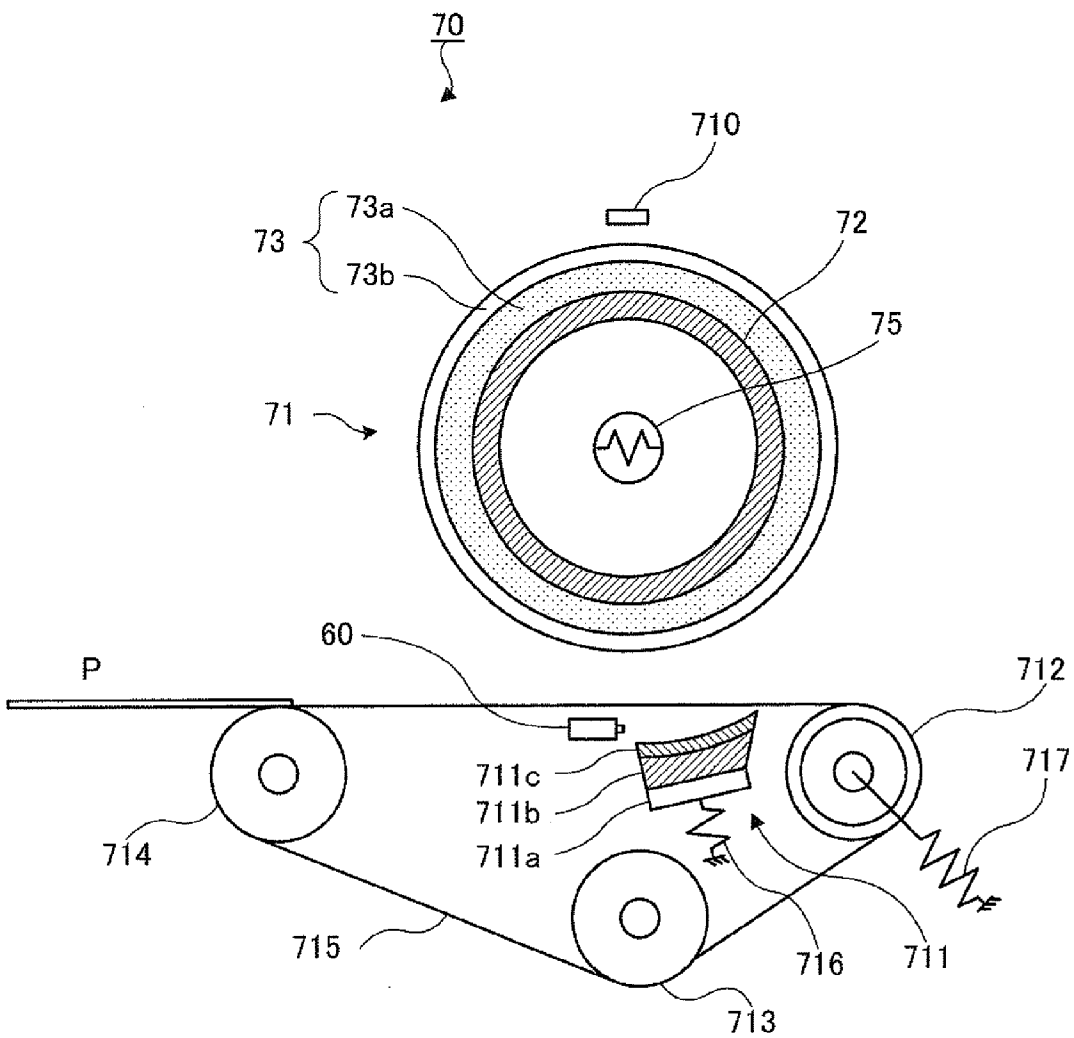
FIG. 6 is a sectional side view showing a schematic configuration of the fixing device in a case where the belt pressurizing device of the third exemplary embodiment is used in the fixing device.

FIG. 6 is a sectional side view showing a schematic configuration of the fixing device 70 in a case where the belt pressurizing device of the third exemplary embodiment is used in the fixing device 70. The configuration of the third exemplary embodiment is such that the micro droplet ejection device 60 supplies lubricant to the sliding surface (the surface of the low friction layer 711*c*) of the pressure application member 711 in the fixing device 70 of the second exemplary embodiment shown in FIG. 5.

Thus, the same reference numerals are given to the same components as those shown in FIG. 5, and the detailed description thereof is omitted.

In FIG. 6, the compression coil spring 716 pressing the pressure application member 711 against the thermal fixing roll 71 and a compression coil spring 717 provided to the pressure roll 712 pressing the endless belt 715 against the thermal fixing roll 71 are loosened. This makes the endless belt 715 in a state where the endless belt 715 is not in contact with the thermal fixing roll 71, and makes the pressure application member 711 in a state where the surface of the low friction layer 711*c* thereof is not in contact with the endless belt 715. The micro droplet ejection device 60 ejects the lubricant to the surface of the low friction layer 711*c*.

Dimethyl silicone oil having viscosity of 1000 cs (product name "KF-96": produced by Shin-Etsu Chemical Co., Ltd.) may be used as the lubricant ejected to the surface of the low friction layer 711*c*. This lowers a friction coefficient between the endless belt 715 and the pressure application member 711.

Note that the micro droplet ejection device 60 of the third exemplary embodiment is the same as that of the first exemplary embodiment in which the intermediate transfer belt 15 is replaced with the endless belt 715. Thus, the detailed description thereof is omitted.

The direction in which the ejecting portion 65 of the micro droplet ejection device 60 ejects the droplets 69 may be arbitrarily set, as described above. Thus, the micro droplet ejection device 60 may be configured so as to eject the lubricant to the surface of the low friction layer 711*c* easily.

Also in the third exemplary embodiment, the micro droplet ejection device 60 supplies the lubricant to the surface of the low friction layer 711*c* of the pressure application member 711, unlike the conventional case (the contact type) where the lubricant supplying member is in contact with the endless belt. Thus, it is not necessary that the lubricant supplying member supplies excessive lubricant and the lubricant removing member removes the excessive lubricant when being brought into contact with the back surface of the endless belt 715. Furthermore, the third exemplary embodiment may prevent the difference observed in the conventional case where the lubricant supplying member is in contact with the endless belt, namely, the difference in the amount of lubricant applied on the endless belt 715 between the initial stage of usage of the lubricant supplying member and the final stage of usage of the lubricant supplying member, in the latter of which the lubricant supply runs short.

Note that the supply amount of the lubricant is determined depending on various usage conditions: a rotational speed of the endless belt 715; an applying pressure of the pressure application member 711; roughness of the back surface of the endless belt 715; a material and roughness of the low friction layer 711*c* of the pressure application member 711; a material of the lubricant; the number of sheets per job; fixing temperature; the total number of rotations of the endless belt 715; and the like. The supply amount of the lubricant may be set on the basis of data obtained in advance by an experiment.

Note that the fixing device 70 may include the micro droplet ejection device 60 according to the second exemplary embodiment supplying the lubricant to the inner surface (the back surface) of the loop of the endless belt 715, as well as the micro droplet ejection device 60 according to the third exemplary embodiment supplying the lubricant to the sliding surface (the surface of the low friction layer 711*c*) of the pressure application member 711.

<Fourth Exemplary Embodiment>

Figure 7:
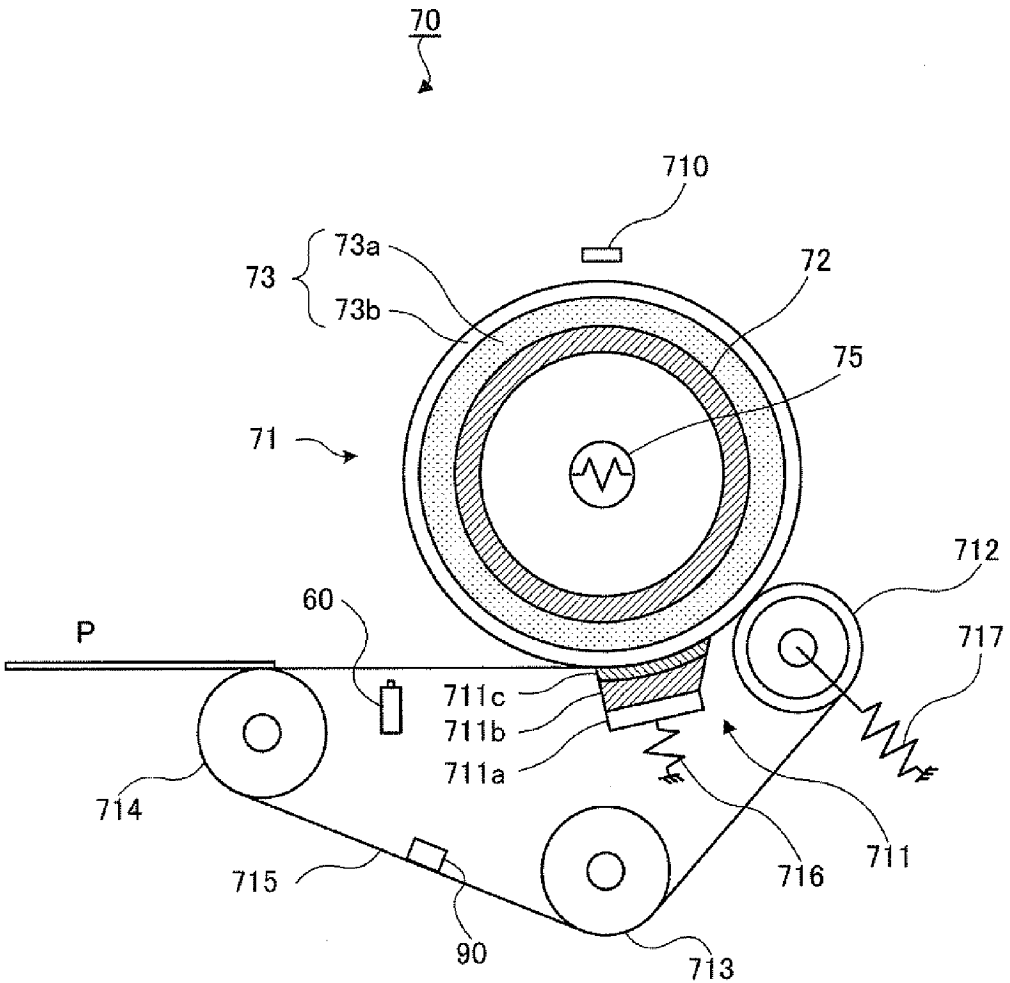
FIG. 7 is a sectional side view showing a schematic configuration of the fixing device in a case where the belt pressurizing device of the fourth exemplary embodiment is used in the fixing device.

FIG. 7 is a sectional side view showing a schematic configuration of the fixing device 70 in a case where the belt pressurizing device of the fourth exemplary embodiment is used in the fixing device 70. The fixing device 70 of the fourth exemplary embodiment further includes a wiping member 90 provided so as to be in contact with the endless belt 715, in the fixing device 70 of the second exemplary embodiment shown in FIG. 5.

Thus, the same reference numerals are given to the same components as those shown in FIG. 5, and the detailed description thereof is omitted.

The wiping member 90 is for wiping stains, abrasion powder and surplus lubricant on the inner surface of the endless belt 715. A felt or the like being capable of containing liquid may be used as the wiping member 90.

Since the micro droplet ejection device 60 supplies the lubricant to the endless belt 715, supply of excessive lubricant may be prevented even in the fourth exemplary embodiment. In addition, provision of the wiping member 90 allows not only surplus lubricant but also stains and abrasion powder on the inner surface of the endless belt 715 to be wiped off. This makes the lifetime of the endless belt 715 longer.

If the wiping member 90 is caused to be continuously in contact with the endless belt 715, the wiping member 90 obstructs the rotation of the endless belt 715 and thus makes the rotation speed of the endless belt 715 slower. This leads to non-uniformity in a formed image and faster abrasion of the surface of the endless belt 715. For this reason, the wiping member 90 may be separated from the surface of the endless belt 715 during the fixing operation of the fixing device 70.

If the wiping member 90 is in contact with the surface of the endless belt 715 without application of pressure while the operation of the fixing device 70 is stopped, the endless belt 715 is likely to have deformation (permanent deformation). Especially when a resin base material with heat resistance is used for the endless belt 715, this permanent deformation is easily generated. If permanent deformation is generated, the deformation remains in the endless belt 715 on the occasion of the fixing operation (immediately after the start of the fixing operation, in particular). Thus, the top edge of the sheet P is likely to flap when the sheet P is introduced into the nip portion N. This leads to occurrence of a bend (a paper bend) or wrinkles (paper wrinkles) at the top edge of the sheet P, or occurrence of a phenomenon called smudge in which an image has disorder because the toner image on the sheet P comes into contact with the thermal fixing roll 71 and the like before the nip portion N.

Furthermore, if surplus lubricant impregnated into the wiping member 90 remains at a portion of the endless belt 715 with which the wiping member 90 is in contact, supply of the lubricant becomes excess at this portion of the endless belt 715. Then, there may be a possibility that the excessive lubricant spills from the side surface of the endless belt 715 on the occasion of the next fixing operation and this leads to swelling of the thermal fixing roll 71 and adhesion of the lubricant to the sheet P.

Accordingly, the wiping member 90 may not be brought into contact with the endless belt 715 while the rotation of the endless belt 715 is stopped, even in a state (non-pressure) where a pressure is not applied.

<Fifth Exemplary Embodiment>

Figure 8:
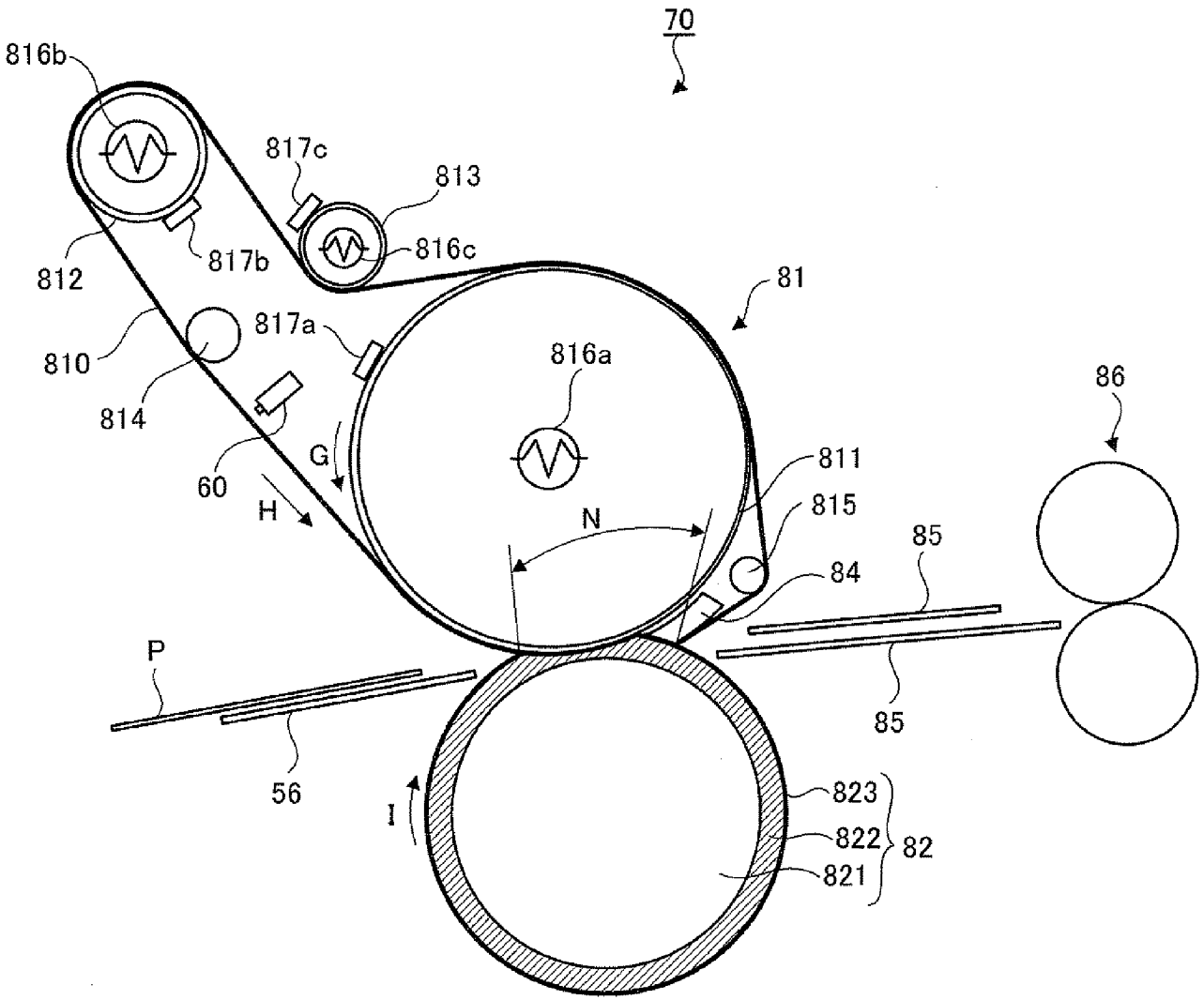
FIG. 8 is a sectional side view showing a schematic configuration of the fixing device in a case where the belt pressurizing device of the fifth exemplary embodiment is used in the fixing device.

FIG. 8 is a sectional side view showing a schematic configuration of the fixing device 70 in a case where the belt pressurizing device of the fifth exemplary embodiment is used in the fixing device 70.

The main part of the fixing device 70 is configured by a fixing belt module 81, and a pressure roll 82 serving as an example of the pressing member that is arranged so as to be in pressure contact with the fixing belt module 81.

The fixing belt module 81 includes: a fixing belt 810 as an example of the endless belt; a fixing roll 811 that rotates while tensioning the fixing belt 810; a tension roll 812 that tensions the fixing belt 810 from the inner side thereof; a tension roll 813 that tensions the fixing belt 810 from the outer side thereof; an attitude correction roll 814 that corrects an attitude of the fixing belt 810 between the fixing roll 811 and the tension roll 812; a peeling pad 84 that is arranged close to the fixing roll 811 in a region on the downstream side in the nip portion N where the fixing belt module 81 is in pressure contact with the pressure roll 82; a tension roll 815 that tensions the fixing belt 810 on the downstream side of the nip portion N.

The fixing belt 810 is a flexible endless belt having a circumferential length of 314 mm and a width of 340 mm. The fixing belt 810 is formed of: a base layer that is made of polyimide resin having a thickness of 80 μm; an elastic body layer that is made of silicone rubber having a thickness of 200 μm, and is stacked on the surface (the outer surface of the loop) of the base layer; and a release layer that is made of tetrafluoroethylene-perfluoroalkylvinylether copolymer (PFA) resin having a thickness of 40 μm covering the elastic body layer.

The fixing roll 811 includes a cylindrical core made of an aluminum alloy having an outer diameter of 65 mm, a length of 360 mm and a thickness of 10 mm. The core has a coating of fluorine resin with a thickness of 200 μm formed on the surface thereof, as a protective layer. However, the configuration of the fixing roll 811 is not limited thereto. The fixing roll 811 may have any configuration as long as the fixing roll 811 is not deformed through pressing force applied by the pressure roll 82. The fixing roll 811 is rotated in the direction of an arrow G at a surface speed of 350 mm/s by drive force from an unillustrated drive motor. Along with this, the fixing belt 810 rotates in the direction of an arrow H.

Additionally, a halogen heater 816*a* rated at 900 W as a heat source is arranged inside of the fixing roll 811. The surface temperature of the fixing roll 811 is controlled by the controller 40 (see FIG. 1) of the image forming apparatus so as to be a predetermined value (for example, 155 degrees C.), on the basis of the measured value of a temperature sensor 817*a* arranged so as to be in contact with the surface of the fixing roll 811.

The tension roll 812 is a cylindrical roll made of an aluminum alloy having an outer diameter of 30 mm, a radial thickness of 2 mm and a length of 360 mm. A halogen heater 816*b* rated at 1000 W as a heat source is disposed inside of the tension roll 812. The surface temperature of the tension roll 812 is controlled by a temperature sensor 817*b* and the controller 40 (see FIG. 1) so as to be a predetermined value (for example, 190 degrees C.).

The tension roll 813 is a cylindrical roll made of an aluminum alloy having an outer diameter of 25 mm, a radial thickness of 2 mm and a length of 360 mm. A fluorine resin layer having a thickness of 20 μm is formed on the surface of the tension roll 813.

A halogen heater 816*c* rated at 1000 W as a heat source is disposed inside of the tension roll 813. The surface temperature thereof is controlled by a temperature sensor 817*c* and the controller 40 (see FIG. 1) so as to be a predetermined value (for example, 190 degrees C.).

Thus, in the fifth exemplary embodiment, the configuration is such that the fixing belt 810 is heated by the fixing roll 811, the tension roll 812 and the tension roll 813.

The attitude correction roll 814 is a columnar roll made of aluminum having an outer diameter of 15 mm and a length of 360 mm. A belt-edge position detecting mechanism (not shown) that detects edge positions of the fixing belt 810 is arranged close to the attitude correction roll 814. The attitude correction roll 814 displaces a contact position of the fixing belt 810 in an axial direction of the attitude correction roll 814 in accordance with a detection result of the belt-edge position detecting mechanism, and thereby inhibits meandering (belt walk) of the fixing belt 810.

The peeling pad 84 is pressed toward the pressure roll 82 so as to uniformly press the fixing belt 810 toward the pressure roll 82. Thus, the surface of the peeling pad 84 facing the pressure roll 82 has a shape following the circumferential surface of the pressure roll 82.

The outer circumferential surface of the peeling pad 84 (the surface with which the peeling pad 84 is in contact with the fixing belt 810, except for the surface facing the pressure roll 82) guides the fixing belt 810 in cooperation with the tension roll 815 and the fixing roll 811 to change directions of movement of the fixing belt 810, and thereby peels the sheet P form the fixing belt 810.

Accordingly, it is necessary that friction between the fixing belt 810 and the outer circumferential surface of the peeling pad 84 remains low.

The tension roll 815 is a columnar roll made of an aluminum alloy having an outer diameter of 12 mm and a length of 360 mm. The tension roll 815 is arranged on the downstream side of the peeling pad 84 in a movement direction of the fixing belt 810 so that the fixing belt 810 after passing through the peeling pad 84 is smoothly rotated towards the fixing roll 811.

Next, the pressure roll 82 is formed of: a columnar roll 821 made of an aluminum alloy having a diameter of 45 mm and a length of 360 mm as a base; an elastic layer 822 made of silicone rubber having durometer hardness of A/30 and a thickness of 10 mm; and a release layer 823 formed of a PFA tube having a film thickness of 100 μm. The elastic layer 822 and the release layer 823 are sequentially stacked on the base. The pressure roll 82 is provided so as to be pressed against the fixing belt module 81, and is driven by the fixing roll 811 to rotate in the direction of an arrow I in accordance with the rotation of the fixing roll 811 of the fixing belt module 81 in the direction of the arrow G. The moving speed of the rotation is 350 mm/s that is the same as the surface speed of the fixing roll 811.

The fixing device 70 further includes the micro droplet ejection device 60 having a similar configuration to that shown in the first exemplary embodiment. The micro droplet ejection device 60 supplies the droplets 69 of the lubricant to the inner surface (the back surface) of the loop of the fixing belt 810, namely, the surface at which the micro droplet ejection device 60 is in contact with the fixing roll 811, the tension roll 812, the attitude correction roll 814, the tension roll 815 and the peeling pad 84.

Note that the micro droplet ejection device 60 of the fifth exemplary embodiment is the same as that of the first exemplary embodiment in which the intermediate transfer belt 15 is replaced with the fixing belt 810. Thus, the detailed description thereof is omitted.

As described above, in the fixing device 70 of the fifth exemplary embodiment, the fixing belt 810, which is an endless belt, is provided with tension by the plural rolls of the fixing roll 811, the tension rolls 812, 813 and 815, and the attitude correction roll 814, and is circularly driven (rotated). Additionally, the pressure roll 82 presses the fixing roll 811 with the fixing belt 810 interposed therebetween. Thereby, the belt pressurizing device including the micro droplet ejection device 60 is configured.

Next, a description is given of an operation of the fixing device 70. The sheet P on which a toner image is transferred at the secondary transfer portion 20 of the image forming apparatus shown in FIG. 1 is transported along the fixing entrance guide 56 from the left side of FIG. 8 to the fixing device 70. The sheet P then enters the nip portion N of the fixing device 70. The toner image is fixed on the sheet P by pressure applied to the nip portion N and heat given through the heated fixing belt 810. The sheet P on which the toner image is fixed is transported along sheet exit guides 85, and then outputted from the image forming apparatus by sheet exit rolls 86.

Also in the fifth exemplary embodiment, the micro droplet ejection device 60 supplies the lubricant to the fixing belt 810, unlike the conventional case (the contact type) where the lubricant supplying member is in contact with the endless belt. Thus, it is not necessary that the lubricant supplying member supplies excessive lubricant and the lubricant removing member removes the excessive lubricant. Furthermore, the fifth exemplary embodiment may prevent the difference observed in the conventional case where the lubricant supplying member is in contact with the endless belt, namely, the difference in the amount of lubricant applied on the fixing belt 810 between the initial stage of usage of the lubricant supplying member and the final stage of usage of the lubricant supplying member, in the latter of which the lubricant supply runs short.

Note that the supply amount of the lubricant is determined depending on various usage conditions: a rotational speed of the fixing belt 810; an applying pressure of the pressure roll 82; roughness of the back surface of the fixing belt 810; a material and roughness of the release layer 823 of the pressure roll 82; a material of the lubricant; the number of sheets per job; fixing temperature; the total number of rotations of the fixing belt 810; and the like. The supply amount of the lubricant may be set on the basis of data obtained in advance by an experiment.

Hereinabove, a transfer device and a fixing device as a belt pressurizing device have been described in the first to fifth exemplary embodiments. However, the belt pressurizing device according to the present invention is not limited to this transfer device and fixing device, but is applicable to any belt pressurizing device that includes an endless belt being provided with tension by plural rolls and circularly driven (rotated) and a pressing member pressing the endless belt.

Moreover, the belt pressurizing device according to the present invention may be applied to both of a transfer device and a fixing device in an image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A belt pressurizing device comprising:

an endless belt that is circularly driven;

a pressing member that presses the endless belt against a facing member with the endless belt interposed between the pressing member and the facing member; and a lubricant supplying member not in contact with the endless belt that supplies lubricant to reduce sliding resistance of the endless belt pressed by the pressing member.

2. The belt pressurizing device according to claim 1, wherein the endless belt is provided with tension by a plurality of rolls and is circularly driven, and the facing member is any one of the plurality of rolls.

3. The belt pressurizing device according to claim 1, wherein the lubricant supplying member supplies the lubricant to an inner surface of the endless belt circularly driven.

4. The belt pressurizing device according to claim 2, wherein the lubricant supplying member supplies the lubricant to an inner surface of the endless belt circularly driven.

5. The belt pressurizing device according to claim 1, wherein the lubricant supplying member supplies the lubricant to a surface of the pressing member at which the pressing member is in contact with the endless belt.

6. The belt pressurizing device according to claim 2, wherein the lubricant supplying member supplies the lubricant to a surface of the pressing member at which the pressing member is in contact with the endless belt.

7. The belt pressurizing device according to claim 3, wherein the lubricant supplying member supplies the lubricant to a surface of the pressing member at which the pressing member is in contact with the endless belt.

8. The belt pressurizing device according to claim 4, wherein the lubricant supplying member supplies the lubricant to a surface of the pressing member at which the pressing member is in contact with the endless belt.

9. The belt pressurizing device according to claim 1, further comprising a wiping member that is provided so as to be in contact with a surface of the endless belt to which the lubricant is supplied.

10. The belt pressurizing device according to claim 2, further comprising a wiping member that is provided so as to be in contact with a surface of the endless belt to which the lubricant is supplied.

11. The belt pressurizing device according to claim 3, further comprising a wiping member that is provided so as to be in contact with a surface of the endless belt to which the lubricant is supplied.

12. The belt pressurizing device according to claim 4, further comprising a wiping member that is provided so as to be in contact with a surface of the endless belt to which the lubricant is supplied.

13. The belt pressurizing device according to claim 5, further comprising a wiping member that is provided so as to be in contact with a surface of the endless belt to which the lubricant is supplied.

14. The belt pressurizing device according to claim 6, further comprising a wiping member that is provided so as to be in contact with a surface of the endless belt to which the lubricant is supplied.

15. The belt pressurizing device according to claim 1, wherein the lubricant supplying member is an ejection device that ejects the lubricant as droplets.

16. The belt pressurizing device according to claim 2, wherein the lubricant supplying member is an ejection device that ejects the lubricant as droplets.

17. The belt pressurizing device according to claim 15, wherein the ejection device has a piezoelectric element deformed by application of a voltage, thereby to eject the lubricant as droplets from a liquid chamber portion of the ejection device in which the lubricant is stored.

18. The belt pressurizing device according to claim 16, wherein the ejection device has a piezoelectric element deformed by application of a voltage, thereby to eject the lubricant as droplets from a liquid chamber portion of the ejection device in which the lubricant is stored.

19. An image forming apparatus comprising:

a charging unit that charges an image carrier;

an exposure unit that exposes the image carrier to form an electrostatic latent image;

a developing unit that develops the electrostatic latent image formed on the image carrier;

a transfer unit that transfers an image developed on the image carrier to a transferred body, the transfer unit including:

an endless belt that is circularly driven;

a pressing member that presses the endless belt against a facing member with the endless belt interposed between the pressing member and the facing member; and a lubricant supplying member not in contact with the endless belt that supplies lubricant to reduce sliding resistance of the endless belt pressed by the pressing member ;and a fixing unit that heats and pressurizes the image on the transferred body, thereby to fix the image.

20. An image forming apparatus comprising:

a charging unit that charges an image carrier;

an exposure unit that exposes the image carrier to form an electrostatic latent image;

a developing unit that develops the electrostatic latent image formed on the image carrier;

a transfer unit that transfers an image developed on the image carrier to a transferred body; and a fixing unit that heats and pressurizes the image on the transferred body, thereby to fix the image, the fixing unit including:

an endless belt that is circularly driven;

a pressing member that presses the endless belt against a facing member with the endless belt interposed between the pressing member and the facing member; and a lubricant supplying member not in contact with the endless belt that supplies lubricant to reduce sliding resistance of the endless belt pressed by the pressing member.

* * * * *